US005372445A

United States Patent [19]

Mutschler

[11] Patent Number: 5,372,445

[45] Date of Patent: Dec. 13, 1994

[54] WRITING UNIT FOR A CARTRIDGE FOUNTAIN PEN

[76] Inventor: Ott Mutschler, Ludolf-Krehl-Strasse 21, 6900 Heidelberg 1, Germany

[21] Appl. No.: 952,855

[22] Filed: Nov. 25, 1992

[30] Foreign Application Priority Data

Jun. 9, 1990 [DE] Germany ..... 4018598

[51] Int. Cl.[5] ..... B43K 5/18

[52] U.S. Cl. ..... 401/225; 401/227; 401/229; 401/242

[58] Field of Search ..... 401/225, 227, 228, 229, 401/242, 226

[56] References Cited

U.S. PATENT DOCUMENTS

| | | | |
|---|---|---|---|
| 1,483,675 | 2/1924 | Peters | 401/228 |
| 3,402,008 | 9/1968 | Green | 401/242 X |
| 3,411,854 | 11/1968 | Rosler et al. | 401/227 |

FOREIGN PATENT DOCUMENTS

| | | | |
|---|---|---|---|
| 0091610 | 10/1983 | European Pat. Off. . | |
| 0140157 | 5/1985 | European Pat. Off. . | |
| 0314893 | 5/1989 | European Pat. Off. . | |
| 1317286 | 2/1963 | France . | |
| 867213 | 2/1953 | Germany | 401/227 |
| 1230331 | 12/1966 | Germany . | |
| 1511371 | 6/1969 | Germany . | |
| 25024 | 4/1931 | Netherlands | 401/225 |
| 307331 | 8/1929 | United Kingdom | 401/227 |
| 761030 | 11/1956 | United Kingdom | 401/227 |
| 831629 | 3/1960 | United Kingdom | 401/227 |
| 885374 | 12/1961 | United Kingdom | 401/226 |

*Primary Examiner*—Steven A. Bratlie
*Attorney, Agent, or Firm*—Bell, Seltzer, Park & Gibson

[57] ABSTRACT

A writing unit for a cartridge fountain pen comprising an ink feeder 3, a writing nib 1 mounted to the forward end portion of the ink feeder, and a gripping piece 2 enclosing the rearward end portion of the ink feeder. A capillary gap 3*a* extends along the longitudinal length of the rearward end portion of the ink feeder and to the writing nib, and an air channel 3*c* of generally triangular outline overlies the gap 3*a*. To compensate for an expansion of air in the writing unit caused by temperature fluctuations, a plurality of lamellar collecting chambers 3*e* are formed in the ink feeder along each side of the capillary gap, with each collecting chamber communicating with one of the two upper corners of the triangular air channel via an overflow capillary 3*d*. Also, to avoid a dripping or leakage of ink after tapping the cartridge, there is provided a fluid control valve which communicates with one of the two upper corners of the triangular air channel at a location adjacent the writing nib. The control valve acts to admit air into the air channel and thus into the cartridge while the ink initially flows along the corners of the triangular air channel by capillary action and until the ink reaches the control valve.

7 Claims, 2 Drawing Sheets

WRITING UNIT FOR A CARTRIDGE FOUNTAIN PEN

BACKGROUND OF THE INVENTION

The invention relates to a writing unit for a cartridge fountain pen, in particular a writing unit for a cartridge fountain pen which includes an ink feeder, a writing nib mounted to the forward end portion of the ink feeder, and a gripping piece enclosing the rearward end portion of the ink feeder. Also, a capillary gap extends along the length of the ink feeder to the writing nib, and an air channel overlies the capillary gap in the radical direction.

Cartridge fountain pens with writing units of the kind under discussion have been known for decades. Cartridges which are filled and closed with a ball at the manufacturer's end, are pierced open for use by means of a pin of the writing unit, the ball which serves as a closure, being pushed into the interior of the cartridge for tapping the cartridge. Even after the cartridge fountain pens under discussion have been introduced for decades, the initial writing in particular with a new or clean cartridge fountain pen continues to be extremely problematic. On the one hand, with conventional writing units or respectively the ink feed systems used therein, it takes minutes and thus too long, after the cartridge is tapped, for the ink to reach the nib point, and for all capillaries important for a satisfactory function to fill with ink.

On the other hand, the risk is incurred after tapping the cartridge that ink leaks out, since while the capillary longitudinal gap of the ink feed system fills with ink immediately after the tapping, i.e., it supplies the nib with ink, the control zone which is important for a regulation of the ink flow and thus serves quasi as a fluid valve, has not yet been filled with ink, thereby allowing air to flow continuously into the cartridge and thus permitting the ink to reach the nib uncontrolled or unmetered. The consequence of ink dripping from the nib exists in particular when, after having been tapped, the cartridge fountain pen is put into a desk stand or placed into a box for shipping.

Until now, leading manufacturers of cartridge fountain pens have offered to eliminate the aforesaid problem in that they equip their fountain pens with cartridges already at plant site, and the cartridge fountain pens thus reach the retail trade in a form ready for writing. Often, the prolonged process of a writing start is shortened by the manufacturer in that the cartridge fountain pens with the cartridge tapped are treated in a centrifuge. Although this relieves a dealer from the time-consuming tapping of the cartridge and the initial writing of the fountain pen, the risk of leakage is especially great during transportation which is normally not free of vibration.

In particular, when air transportation is selected, the occurring pressure and temperature differences will lead to a forced leakage of ink especially when the ink feeder is designed for large writing widths, because of expanding ink or air, whereby considerable damage can be caused.

Finally, the so far known writing units, in particular with the use of an ink feeder for large writing widths, are problematic in so far as they offer only little protection against blotting when the throughput of ink is large.

It is therefore the object of the invention to design and further develop the writing unit for cartridge fountain pens of the initially described kind such that, in particular with ink feeders dimensioned for large writing widths, first, a dripping or a leaking of ink after tapping the cartridge is prevented and the procedure is accelerated, and, second, a blotting is largely prevented at pressure and temperature fluctuations.

SUMMARY OF THE INVENTION

The above and other objects and advantages of the present invention are achieved by the provision of a writing unit having the above described components, and wherein the air channel which overlies the capillary gap has outwardly diverging side walls such that the side walls and the adjacent portion of the gripping piece have a generally triangular outline when viewed in transverse cross section and define two corners which act as capillaries during the initial delivery of ink to the writing unit. A plurality of lamellar collecting chambers are formed in the ink feeder along each side of the capillary gap, with each collecting chamber communicating with one of the two corners of the triangular air channel via an overflow capillary. Also, there is provided a fluid control valve which communicates with one of the two corners of the triangular air channel at a location adjacent the writing nib. The control valve acts to admit air into the air channel and thus into the cartridge while the ink initially flows along the corners of the triangular air channel by capillary action and until the ink reaches the control valve.

In the preferred embodiment, the control valve takes the form of a passage formed on the surface of the ink feeder adjacent the nib and which communicates with the corner of the triangular air channel and with the outside air. Also, the passage preferably has a cross-sectional area which is significantly greater than that of each one of the overflow capillaries.

When tapping a cartridge in a writing unit according to the present invention, not only the capillary gap is supplied with ink, but also the two triangular corners of the air channel will be filled with ink almost simultaneously as a result of their capillary action. Thus, the control passage of the valve and the overflow capillaries will be filled with ink, and in consequence, the inflow of air into the cartridge is stopped so that the ink is prevented from flowing further. Since the control passage is positioned at the end of the assembly of the collecting chambers adjacent the nib, the ink is only prevented from flowing further after it has arrived at the nib. Thus, the writing unit is ready for use nearly immediately after tapping a cartridge, and in addition, the ink is prevented from dripping.

Upon writing with the writing unit, the ink in the writing unit and also in the control passage of the valve will be removed. Then an inflow of air into the cartridge via the control passage can take place as long as the ink is being removed from the writing unit and until the control passage is again filled with ink. Thus the control passage acts like a valve.

Furthermore, it has been recognized that it is necessary to provide for adequate space into which the ink can escape as a result of temperature fluctuations which is accomplished by the above described collecting chambers.

In accordance with the invention, it has further been recognized that a rapid filling of the control passage with ink is possible by a specific configuration of the air channel.

Finally, it has been accomplished in accordance with the invention by combining different features which relate to the configuration of the ink feeder, that the control passage fills with ink as quickly as possible. Should a vacuum develop while writing, the control passage will empty itself, i.e., open, and let air flow through the air channel in direction of the cartridge. Finally the control passage is again closed by ink flowing in the wake, provided there is no longer a vacuum, i.e. no more ink is extracted.

Further, in accordance with the invention, the collecting chambers take up the expanding air or the ink in the ink feeder. Consequently, when the air expands, for example as a result of temperature fluctuations, the ink will not be pushed out of the ink feeder toward the nib, but enters, via overflow capillaries, into the collecting chambers which are operatively connected to one another on the one hand and to the longitudinal channel or respectively the air channel on the other.

Consequently, the measures of this invention prevent on the one hand a dripping of ink, especially also when the ink feeder is designed for large writing widths and, thus, for a considerable ink feed volume.

Furthermore, it is of advantage that a separate overflow capillary is provided for each collecting chamber. The collecting chambers are therefore operatively connected to one another exclusively via overflow capillaries on the one hand, and to the longitudinal gap or respectively the air channel on the other. The consequence of such a configuration of the ink feeder is that even when the capillary longitudinal gap is dimensioned to realize large writing widths, i.e., when a high throughput of ink is realized, the ink in the ink feeder is not pushed out therefrom, when gas or air in the ink feeder expands as a result of temperature fluctuations. This is explained by the entering of the ink, via defined flow paths into the collecting chambers which serve as an ink reservoir, and assume in this instance the function of a buffer.

Since the collecting chambers compensate for the expansion of air resulting from temperature fluctuations, the foregoing features ensure a reliable control of the ink, thereby avoiding a leakage, and increasing, in particular, also the vibrating strength. A considerable resistance to temperature fluctuations is guaranteed.

As regards a fast filling of the air channel with ink, if possible, immediately after the cartridge is tapped, it is of further advantage that the air channel widens with stepped walls toward the side opposite to the longitudinal gap. In this instance, starting from the capillary longitudinal gap, the ink fills the air channel step by step, whereby with an adequately good wetting behavior between the ink feeder and the ink, the air channel as a whole is rapidly filled with ink. Thus, the ink enters also quickly into the overflow capillaries and finally into the control passage.

Likewise, it is possible that the air channel widens with corrugated walls toward the side opposite to the longitudinal gap, thereby avoiding, in comparison with the foregoing configuration, sharp edges which may be "hurdles" for the expansion of the ink, and thus further accelerating the filling process.

In accordance with a further, advantageous embodiment, the air channel widens with concave or convex walls toward the side opposite to the longitudinal gap. Also in this case, a rapid filling of the air channel with ink occurs. In this connection, it would further be possible to limit the side of the air channel opposite to the longitudinal gap by a likewise concave or convex wall. Finally, it is of special advantage, both with respect to a short filling time of the air channel and with respect to a configuration of the air channel which is simple as regards its design and manufacture, that the air channel widens toward the surface opposite to the longitudinal gap such that the air channel has a triangular cross section. In this case, the triangular cross section could have the shape of an isosceles triangle or the shape of an equal-sided triangle.

BRIEF DESCRIPTION OF THE DRAWINGS

Some of the objects and advantages of the present invention having been stated, others will become apparent as the description proceeds, when considered in conjunction with the accompanying drawings, in which.

DETAILED DESCRIPTION OF THE PREFERRED EMBODIMENT OF THE INVENTION

Figure 1:
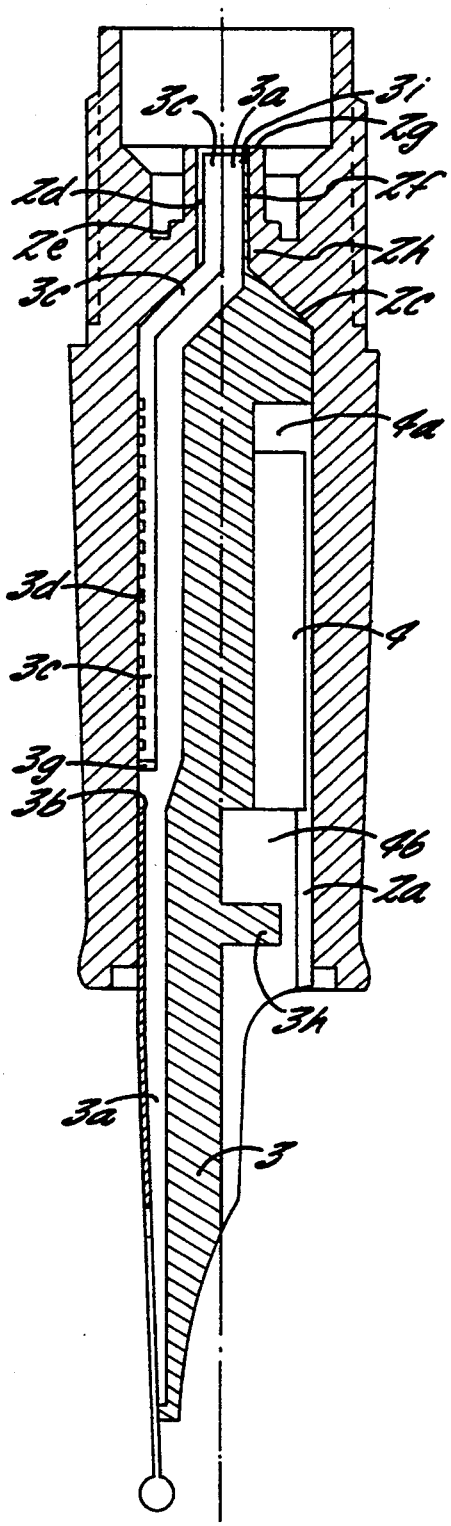
FIG. 1 is a schematic, sectional side view of a writing unit in accordance with the invention for a cartridge fountain pen.
Figure 2:
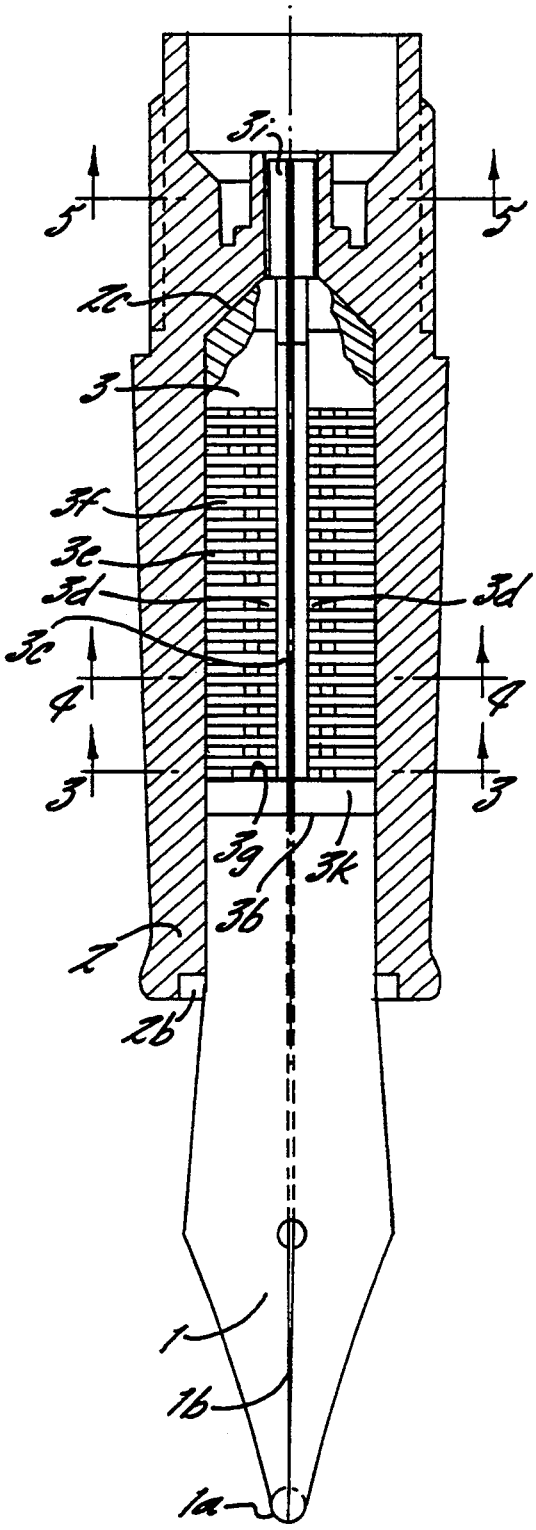
FIG. 2 is a schematic, sectional top view of the article of FIG. 1.

FIGS. 1 and 2 show an embodiment of a writing unit in accordance with the invention for a cartridge fountain pen. The writing unit, here only illustrated as an example, comprises as essential parts a nib 1, a gripping piece 2, and an ink feeder 3.

The ink feeder 3 comprises lamellarly formed collecting chambers **3*e*, with a capillary longitudinal gap 3*a* extending over the entire length of the ink feeder 3 on its side facing nib 1. Over the entire range of the collecting chambers 3*e*, the longitudinal gap 3*a* merges outward into an air channel 3*c* which occupies a substantially greater cross sectional area than the longitudinal gap 3*a*. The side of air channel 3*c* opposite to the longitudinal gap 3*a* extends up to overflow capillaries 3*d* which connect to collecting chambers 3*e*. In the longitudinal direction, the air channel 3*c* extends up to a control passage 3*g* provided at the nib-side end of the collecting chambers 3*e***.

In accordance with the invention, the air channel **3*c* extends in longitudinal direction over the entire range of collecting chambers 3*e* up to a control passage 3*g* which is formed at the end of the collecting chambers 3*e* facing nib 1, and serves as a fluid valve. In radial direction, the air channel 3*c* is bordered by a surface opposite to the longitudinal gap 3*a*. On the side opposite to longitudinal gap 3*a*, the air channel 3*c* extends to overflow capillaries 3*d* operatively connecting to collecting chambers 3*e***.

Altogether, the Figures show that the collecting chambers 3e are operatively connected between one another and with the air channel 3c or respectively the longitudinal gap 3a exclusively via overflow capillaries 3d. Accordingly, ink and air enter into the collecting chambers 3e and exit therefrom exclusively via the overflow capillaries 3d.

Figure 3:
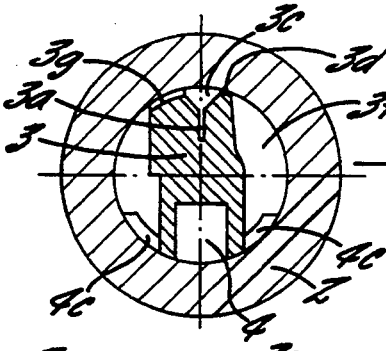
FIG. 3 is a schematic, sectional view along the line 3—3 showing an enlarged detail of the article of FIG. 2.
Figure 3A:
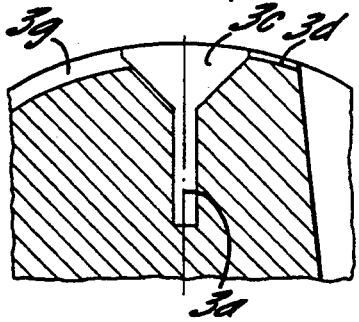
FIG. 3A is an enlarged fragmentary view of a portion of FIG. 3.
Figure 4:
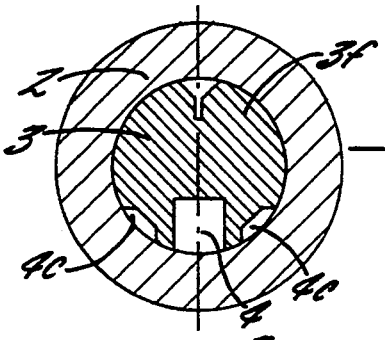
FIG. 4 is a schematic, sectional view along the line 4—4 showing an enlarged detail of the article of FIG. 2.
Figure 4A:
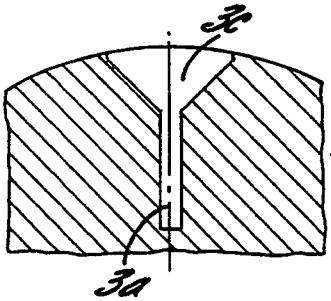
FIG. 4A is an enlarged fragmentary view of a portion of FIG. 4.
Figure 5:
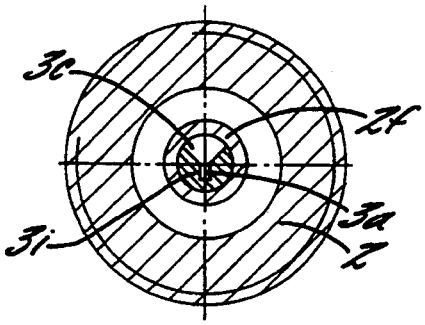
FIG. 5 is a schematic, sectional view along the line 5—5 showing and enlarged detail of the article of FIG. 2.

FIGS. 3, 4, and 5 show especially clearly that the air channel 3c widens toward the surface opposite to the longitudinal gap such that the air channel 3c has a triangular cross section. In the preferred embodiment, the triangular cross section of the air channel 3c has the shape of an isosceles triangle.

FIGS. 1 and 2 show in addition to the above described, essential features of the present invention that nib 1 has a writing point 1a and a slot 1b. The gripping piece 2 is provided with a bore 2a, a recess 2b, a transverse stop 2c, an offset bore 2d, a projection 2e, a piercing pin 2f with a rearward end 2g, and a flange 2h.

The ink feeder 3 comprising capillary gap 3a and air channel 3c, further includes a stop 3b for nib 1, overflow capillaries 3d, collecting chambers 3e operatively connected via overflow capillaries 3d with air channel 3c or respectively capillary gap 3a, lamellae 3f defining the collecting chambers 3e, a control passage 3g serving as a fluid valve, a transverse rib 3h, a pin 3i, and a flange 3k. Further shown are air grooves 4, 4b and a transverse groove 4a.

In the sectional view of FIG. 3, one can clearly see gripping piece 2, ink feeder 3, and capillary longitudinal gap 3a. As described above, the air channel 3c has the shape of a triangle. Further shown in this illustration are lamellae 3f, overflow capillaries 3d, control passage 3g, air groove 4, and air grooves 4c.

FIG. 4 is a cross sectional view of the article shown in FIGS. 1 and 2, but differently placed than in FIG. 3, namely along the line 4—4. Also here, one can note gripping piece 2, ink feeder 3, and one lamella 3f. One can further note in this illustration, the position or respectively the configuration of the capillary gap 3a, the air channel 3c with its triangular cross section, the air groove 4, and air grooves 4c.

Finally, FIG. 5 shows again a sectional view of the article in FIGS. 1 and 2 along the line 5—5. In this illustration, one can clearly see gripping piece 2 with piercing pin 2f, and pin 3i on ink feeder 3. Further shown is the capillary longitudinal gap 3a in pin 3i on ink feeder 3.

In the following and with reference to the above described Figures, the operation of a writing unit in accordance with the invention will be described in more detail.

When tapping the cartridge in conventional writing units, the ink flows always, as result of the capillary effect, first into the capillary longitudinal gap, and from there to the nib. Only as a result of a backflow from the nib, namely a backflow in the capillary longitudinal gap, do the control zone, the air channel, and the overflow capillaries gradually fill with ink, so that a further inflow of air into the cartridge, and thus an outflow of ink from the cartridge are prevented.

Normally, this procedure takes a few minutes, and leads to an undesired dripping of ink from the slot in the nib, especially when the fountain pen is put, immediately after the cartridge is tapped, with the nib downward into a quiver or the like provided therefor in a desk stand. Likewise, when the air in the writing unit expands, a dripping will occur because the ink is displaced by the expanded air.

In the writing unit of the present invention, however, the following will occur: when the cartridge not shown in the Figures is pierced, the closing ball of the cartridge is pushed from the front end of the cartridge by piercing pin 2f on gripping piece 2 into the cartridge and is thereby opened. The ink can thus flow into the ink feed system. As the cartridge is tapped, the volume of the ball and the piercing pin 2f cause the air in the cartridge to compress, which favors the initial writing of the writing unit. The configuration of ink feeder 3 in accordance with the invention accomplishes that not only the capillary gap 3a which supplies ink to the nib 1, but also the two upper corners of the triangular air channel 3c fill with ink almost simultaneously as a result of their capillary action. The ink flowing out of the cartridge fills the capillary corners of the triangle of the air channel almost simultaneously together with the capillary longitudinal gap 3a, in both cases by capillary action.

In accordance with the invention, the overflow capillaries 3d on ink feeder 3 and the control passage 3g are filled with ink in good time and closed so that the ink is prevented from flowing further, once it has arrived by capillary action in slot 1b of the nib. The reason therefor is that the control passage 3g which is closed by the ink, does no longer permit air to flow into the cartridge, thereby finally ensuring that the ink is prevented from dripping.

The collecting chambers 3e further serve to receive ink in the event that air expands in capillary longitudinal gap 3a or air channel 3c, and thus compensate for an expansion of air in the writing unit, which is caused by temperature fluctuations. Thus, a dripping of ink is effectively prevented. Based on the fact that the collecting chambers 3e and the capillary longitudinal gap 3a or respectively air channel 3c are exclusively interconnected via individual overflow capillaries 3d, this measure affords not only this protection at temperature fluctuations, but also a certain vibrating strength, in particular with ink feeders 3 which are designed for writing widths of up to about 2.7 mm.

Finally, it should be pointed out that the essence of the present invention, namely a prevention of an unwanted dripping in a writing unit, also in the course of temperature fluctuations, can be realized by a special configuration of the ink feeder likewise in other writing utensils which are provided with a writing unit as described above or a similar writing unit.

I claim:

1. A writing unit for a cartridge fountain pen comprising an ink feeder (3) having a forward end portion and a rearward end portion, a writing nib (1) mounted to the forward end portion of said ink feeder, a gripping piece (2) enclosing at least the rearward end portion of said ink feeder (3), a capillary gap (3a) extending along the longitudinal length of said rearward end portion of said ink feeder and to said writing nib, an air channel (3c) extending along the longitudinal length of said rearward end portion of said ink feeder and so as to overlie and communicate with said capillary gap, said air channel including outwardly diverging side walls such that said side walls and the adjacent portion of said gripping piece have a generally triangular outline when viewed in transverse cross-section and define two corners which act as capillaries during the initial delivery of ink to said writing unit, a plurality of lamellar collecting chambers 3(*e*) formed in said ink feeder along each side of said capillary gap, with each of said collecting chambers communicating with said air channel via an overflow capillary (3*d*) which is formed on the surface of said ink feeder and extends from one of said corners to the associated collecting chamber, and fluid valve control means formed in said ink feeder so as to communicate with one of said corners at the end of said air channel adjacent said writing nib, for admitting air into said air channel only until the ink which initially flows along said two corners by capillary action reaches said control means.

2. The writing unit as defined in claim 1 wherein said side walls and the adjacent portion of said gripping piece are in the form of an isosceles triangle when viewed in transverse cross-section.

3. The writing unit as defined in claim 1 wherein said writing nib includes a slot (1*b*) extending along its length and in longitudinal alignment with and in communication with said capillary gap (3*a*).

4. The writing unit as defined in claim 3 wherein said writing nib further includes a free end which is spaced from said ink feeder (3) and a writing point (1*a*) at said free end and which is aligned with said slot (1*b*).

5. The writing unit as defined in claim 1 wherein said fluid valve control means comprises a control passage (3*g*) formed on the surface of said ink feeder which communicates with said one of said corners and with the outside air.

6. The writing unit as defined in claim 5 wherein said control passage (3*g*) has a cross-sectional area significantly greater than that of each one of said overflow capillaries (3*d*).

7. The writing unit as defined in claim 5 wherein said gripping piece includes a cartridge piercing pin (2*f*) enclosing the rearward end portion of said ink feeder, and such that upon piercing the cartridge the ink is free to enter said capillary gap (3*a*) of said ink feeder.

* * * * *